United States Patent [19]

Seehofer et al.

[11] 4,207,906

[45] Jun. 17, 1980

[54] METHOD OF MAKING A CIGARETTE

[75] Inventors: Friedlieb Seehofer, Pinneberg; Helmut Kalies, Bünningstedt, both of Fed. Rep. of Germany

[73] Assignee: B.A. T. Company Limited, Hamburg, Fed. Rep. of Germany

[21] Appl. No.: 870,240

[22] Filed: Jan. 17, 1978

[51] Int. Cl.[2] ..... A24C 5/39

[52] U.S. Cl. ..... 131/21 D; 131/234; 131/8 R

[58] Field of Search ..... 131/21 R, 21 C, 108, 131/21 D, 8 R; 264/37, 113, 115, 122

[56] References Cited

U.S. PATENT DOCUMENTS

| | | | |
|---|---|---|---|
| 2,570,270 | 10/1951 | Patterson | 131/108 |
| 3,028,865 | 4/1962 | Hagenah et al. | 131/108 |
| 3,736,941 | 6/1973 | Molins | 131/21 R |

FOREIGN PATENT DOCUMENTS

| | | | |
|---|---|---|---|
| 1242182 | 8/1960 | France | 131/108 |

*Primary Examiner*—Robert W. Michell
*Attorney, Agent, or Firm*—Bierman & Bierman

[57] ABSTRACT

A method of making a cigarette having a core of one grade of tobacco and at least one substantially circumferential wrapping of a second grade of tobacco which comprises applying to a moving base or conveyor a first stream of the core tobacco and a pair of second streams of the wrapping material, one stream of wrapping material being on either side of the first stream. The three streams are then deposited onto a moving support which is at an angle to the base such that one stream of wrapping material is deposited upstream of the core material which, in turn, is deposited upstream of the other stream of wrapping material. The composite layer thus formed is then formed into a tobacco cord in a known manner. The latter is then formed into cigarettes in the usual way.

A modification of known cigarette-making machines is described which is particularly adapted for carrying out this method.

12 Claims, 5 Drawing Figures

Fig.1
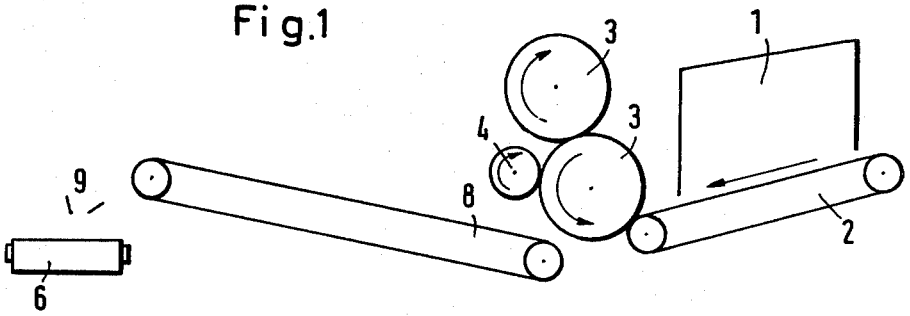
Fig.3
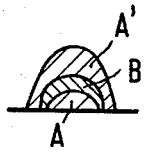
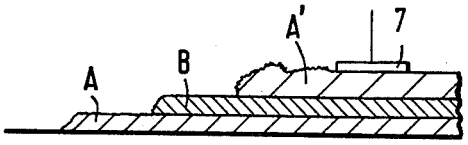
Fig.4
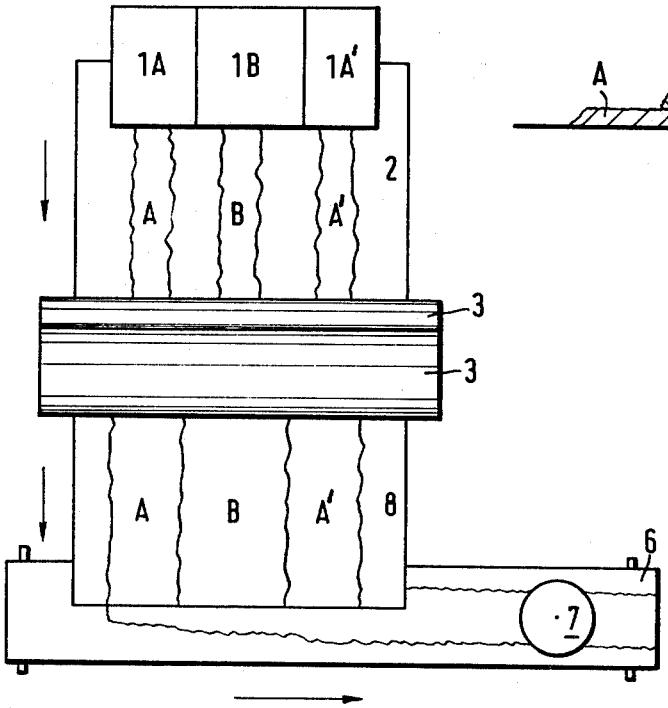
Fig.5
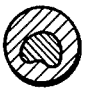
Fig.2

METHOD OF MAKING A CIGARETTE

The present invention is directed to the manufacture of a cigarette comprising a core and at least one wrapping substantially surrounding the core; more specifically, to a method of making a cigarette having a core of cheaper tobacco and a concentric "shell" of higher quality tobacco.

In cigarettes of the foregoing general character, it has been found that the taste depends primarily on the quality of the wrapper and the nature of the core is of little or no importance. Clearly, it would permit a substantial economic saving, with little or no loss of flavor, to produce a cigarette in which the central portion or core is made of a cheap tobacco, while the external wrapper is made of expensive tobacco. By this means, the cigarette tastes substantially as if it were made of the high grade tobacco, even though a substantial portion of it is of much cheaper material.

Cigarettes of this character have been made previously. For example, German Patent Publications Nos. 20 15 387 and 22 48 976 describe processes in which the tobacco layer to be used as the wrapper is bent into a U cross-section, core material is deposited into the cavity formed, and additional wrapper is deposited on the top. As can easily be seen, methods of this character require expensive instrumentation and sophisticated cigarette-making machines in order to produce a commercially satisfactory product.

The present invention is intended to provide a method which can be carried out on ordinary cigarette-making machines without requiring any major structural modifications thereof. This has the advantage of enabling an existing manufacturer to use his already-installed equipment to produce this type of cigarette. Moreover, he can, without undue difficulty, switch from manufacturing of the standard cigarette to manufacture of cigarettes according to the present invention.

In accordance with the present invention, a cigarette having a core of a first material and at least one concentric wrapping of at least one second material is produced by applying to a moving base a first stream of the first material and at least one pair of second streams of the second material. One of each second stream is on each side of the first stream. These form three parallel webs which are carried by the moving base to a moving support.

The support is moving at an angle to the base so that a line, parallel to the plane of the support, through all three streams is substantially parallel to the direction of movement of the support.

The first and second streams or webs are deposited onto the moving support. As a result of the arrangement of the moving support with relation to the three streams of materials, one stream of the second material is deposited upstream of the first material and the first material is, in turn, deposited upstream of the other stream of second material, thus forming a composite layer comprising a top layer and a bottom layer (both of the second material) and a core layer (of the first material) located therebetween. The composite layer is then formed into a tobacco cord in the usual manner. The cord is thereafter formed into cigarettes as is generally known.

In a preferred embodiment of this invention, it has been found advantageous to trim the excess from the top layer of the composite layer prior to forming the tobacco cord. In a particularly preferred form of the invention, the tobacco obtained from the trimmings is recycled in the process. However, it is of importance to return these trimmings to the stream which comprises the bottom of the composite layer. If the trimmings are returned to the top of the composite layer, the possibility exists that they will be trimmed off a second time, resulting in excessive undesirable accumulation of finer cut material in one of the streams of second material.

As another preferred form of the invention, the first stream of first material is constrained as it is deposited on the moving support. The constraint is advantageously provided by a pair of guide plates through which the stream flows. This results in a web of first material which is narrower than the corresponding two webs of second material. Thus, the second material or wrapper will enclose the first material or core substantially completely in the finished product.

In the accompanying drawings constituting a part hereof and in which like reference characters indicate like parts:

FIG. 1 is a schematic view of a device for carrying out the process of the present invention;

FIG. 2 is a diagramatic plan view of FIG. 1;

FIG. 3 is a diagramatic, cross-sectional view of the composite layer;

FIG. 4 is a longitudinal section of the composite layer of FIG. 3; and

FIG. 5 is a cross-sectional view of the finished tobacco cord.

The device comprises hopper 1 which opens on to conveyor 2. This conveyor carries the materials to a pair of cooperating barbed rollers 3 and 3'. Rollers 3 and 3' pick up the materials and, in conjunction with the action of the beater roll 4, throw the materials onto moving base 8. This base deposits the materials onto moving support 6 whence they are formed into the tobacco cord.

Referring more particularly to FIG. 2, hopper 1 is divided into compartments 1A, 1B and 1A'. Each of these compartments contains a component of the ultimate composite layer. Compartment 1A contains the second material which forms the bottom layer, compartment 1B contains the first material which is the core layer, and compartment 1A' contains the second material which becomes the top layer.

The three compartments deposit their respective contents on conveyor 2 in first stream B and a pair of second streams A and A'.

These streams are carried to barbed rollers 3 and 3' which pick them up independently and, with the aid of beater rollers 4 (not shown in FIG. 2), deposit them on moving base 8.

Base 8, in turn, deposits the three substantially discrete streams on moving support 6, located at right angles to the path of base 8. As can be seen from the drawings, one second stream A is deposited upstream of first stream B, which is deposited upstream of the other second stream A'. This produces the composite layer shown in FIGS. 3 and 4. Subsequent to the formation of the composite layer, the material A' of the top layer is trimmed by trimmer 7. This device is advantageously a rapidly rotating disc which cuts excess tobacco off the top layer. As previously stated, the trimmings from this operation are recycled to hopper 1A. In this manner, the trimmings become part of the bottom layer and run no risk of being trimmed a second time and further reduced in size.

The composite layer is then formed, in known manner (not shown), into the usual tobacco cord of FIG. 5. This is converted into cigarettes in the usual manner.

In the preferred form of the invention, stream B, as it is deposited on support 6, passes between guide plates 9 which constrain and confine the flow so that the core layer as deposited on support 6 is narrower than the corresponding top and bottom layers of the second material. In this manner, it is insured that the top and bottom layers will entirely encompass the core layer.

Although only a limited number of embodiments of this invention have been specifically disclosed, modifications and variations can be made without departing from the scope or spirit thereof. For example, it is possible to eliminate both the conveyor and the moving base and have the hopper located directly over the moving support. It is, of course, within the contemplation of this invention that a series of substantially concentric wrapping materials be used. It would thus be possible to obtain desired "blends" of materials within the cigarette in a succession of layers. The manner of producing such a cigarette, including the arrangment of compartments, streams, etc., is analogous to the method specifically disclosed herein.

It is also contemplated that different materials be used in the manufacture of the cigarette. Various additives may be included which provide desirable properties in the product. Substances which increase the number of puffs obtainable, those which favorably effect the carbon monoxide formation, substances which improve the burning characteristics, etc., may all be incorporated in the core without materially effecting the taste, even though these same substances would be unacceptable if they were distributed uniformly throughout the entire cigarette. Naturally, it is to be expected that the high quality, good-tasting tobacco will form the wrapper, while a much lower quality, poorer-tasting tobacco will be used for the core. In this way, the maximum flavor enhancement can be obtained with a minimum use of expensive, high-quality tobacco.

It has also been found advantageous to provide that the partitions which divide the hopper into the desired number of compartments be adjustable. If they can be moved so that the relative sizes of the compartments are pre-set, it is possible to adjust the ratio of the various materials being used and to predetermine the ratio of the thickness of the wrapper(s) to the core.

It will be appreciated that, although this description has implied that the core is cylindrical and the wrapper similarly shaped, it is understood that, in actuality, the core frequently assumes lenticular or sickle-like shapes. The precise nature of the shapes actually encountered is of no real importance for purposes of the present invention.

What we claim is:

1. In a method of making a cigarette having a core of a first material and at least one wrapping of at least a second material surrounding said core, said wrapping and said core comprising different smoking materials, the improvement which comprises applying to a moving base a first stream of said first material and at least one pair of second streams of said second material, one second stream on either side of said first stream, said moving base depositing said first and second streams onto a support moving at an substantially a right angle to said base such that a line through said first stream and said second streams is substantially parallel to the direction of movement of said support, whereby one stream of said second material is deposited upstream of said first material which, in turn, is deposited upstream of the other stream of said second material, thereby forming a composite layer comprising a top layer, a bottom layer and a core layer therebetween, said composite layer being adapted to be formed into a tobacco cord.

2. The method of claim 1 wherein said first material is a lower grade tobacco than said second material.

3. The method of claim 1 wherein said first stream is constrained during said depositing so that it is narrower than each of said second streams.

4. The method of claim 1 wherein said top layer is trimmed after said depositing.

5. The method of claim 4 wherein said second material trimmed from said top layer is recycled to said one of said second streams.

6. The method of claim 1 wherein said angle is substantially a right angle.

7. The method of claim 1 wherein said first material is charged into a first compartment of a hopper, said second material is charged into a pair of second compartments, one compartment being on either side of said first compartment, said materials being discharged from said compartments onto said moving base.

8. The method of claim 7 wherein said compartments are adjustable.

9. The method of claim 3 wherein said first stream is constrained by a pair of guide plates between which said first stream flows.

10. The method of claim 1 wherein said streams of said first and second materials are applied to a conveyor and conveyed thereby to said base before application to said base.

11. The method of claim 10 wherein said first material is charged into a first compartment of a hopper, said second material is charged into a pair of second compartments, one compartment being on either side of said first compartment, said materials being discharged from said compartments onto said conveyor.

12. The method of claim 11 wherein said compartments are adjustable.

* * * * *